US010767589B2

(12) United States Patent
Nodera

(10) Patent No.: US 10,767,589 B2
(45) Date of Patent: Sep. 8, 2020

(54) CONTROL DEVICE FOR INTERNAL COMBUSTION ENGINE

(71) Applicant: DENSO CORPORATION, Kariya, Aichi-perf. (JP)

(72) Inventor: Masato Nodera, Kariya (JP)

(73) Assignee: DENSO CORPORATION, Kariya (JP)

( * ) Notice: Subject to any disclaimer, the term of this patent is extended or adjusted under 35 U.S.C. 154(b) by 220 days.

(21) Appl. No.: 15/518,663

(22) PCT Filed: Nov. 2, 2015

(86) PCT No.: PCT/JP2015/005503
§ 371 (c)(1),
(2) Date: Apr. 12, 2017

(87) PCT Pub. No.: WO2016/072083
PCT Pub. Date: May 12, 2016

(65) Prior Publication Data

US 2017/0234256 A1 Aug. 17, 2017

(30) Foreign Application Priority Data

Nov. 5, 2014 (JP) ..... 2014-224856

(51) Int. Cl.
*F02D 41/22* (2006.01)
*F02D 41/00* (2006.01)
(Continued)

(52) U.S. Cl.
CPC ..... *F02D 41/22* (2013.01); *F02D 29/02* (2013.01); *F02D 41/009* (2013.01);
(Continued)

(58) Field of Classification Search
CPC ..... F02D 41/22; F02D 41/042; F02D 41/009; F02D 41/26; F02D 41/065; F02D 29/02;
(Continued)

(56) References Cited

U.S. PATENT DOCUMENTS

2008/0010037 A1* 1/2008 Hashizume ..... F02D 41/009 702/151
2011/0290010 A1* 12/2011 Fulks ..... F02D 41/009 73/114.26

(Continued)

FOREIGN PATENT DOCUMENTS

JP 11-351050 12/1999
JP 2000-097097 4/2000

(Continued)

OTHER PUBLICATIONS

International Search Report for PCT/JP2015/005503, dated Dec. 15, 2015, 4 pages.

*Primary Examiner* — Joseph J Dallo
*Assistant Examiner* — Scott A Reinbold
(74) *Attorney, Agent, or Firm* — Nixon & Vanderhye P.C.

(57) ABSTRACT

A crank angle sensor that outputs a crank angle signal at a predetermined crank angle by synchronizing rotation of a signal rotor fixed on a crank shaft of an internal combustion engine, an interval of the crank angle signals being longer at a specific crank angle corresponding to a position of a crank position reference part of the signal rotor, includes a backward rotation detecting function that outputs different crank angle signals in a forward rotation of the crank shaft and in a backward rotation of the crank shaft, and a control part disallows the detection of the crank position reference part when a stop request to the internal combustion engine is generated or when the backward rotation of the crank shaft is detected based on the crank angle signal, and controls the internal combustion engine by calculating the crank angle based on the crank angle of the crank position reference part detected before the detection of the crank position reference part is disallowed and the crank angle signal.

8 Claims, 3 Drawing Sheets

(51) Int. Cl.

| | |
|---|---|
| ***F02D 41/04*** | (2006.01) |
| ***F02D 41/06*** | (2006.01) |
| ***F02D 41/26*** | (2006.01) |
| ***F02N 11/08*** | (2006.01) |
| ***F02D 29/02*** | (2006.01) |

(52) U.S. Cl.
CPC ..... *F02D 41/042* (2013.01); *F02D 41/065* (2013.01); *F02D 41/26* (2013.01); *F02D 2041/0092* (2013.01); *F02D 2200/101* (2013.01); *F02D 2250/06* (2013.01); *F02N 11/0822* (2013.01)

(58) Field of Classification Search
CPC ..... F02D 2250/06; F02D 2041/0092; F02D 2200/101; F02D 2009/0245; F02D 2009/0247; F02D 2041/0095; F02D 2200/021; F02N 11/0822; F02N 11/08; F02N 2250/04
USPC ..... 701/112
See application file for complete search history.

(56) References Cited

U.S. PATENT DOCUMENTS

| | | | | |
|---|---|---|---|---|
| 2012/0303251 | A1* | 11/2012 | Shimizu | F02D 13/0238 701/113 |
| 2014/0060486 | A1* | 3/2014 | Maezawa | F02D 45/00 123/350 |
| 2016/0069316 | A1* | 3/2016 | Miwa | B60W 20/40 123/179.3 |

FOREIGN PATENT DOCUMENTS

| | | |
|---|---|---|
| JP | 2005-320945 | 11/2005 |
| JP | 2006-214408 | 8/2006 |
| JP | 2009-002193 | 1/2009 |
| JP | 2010-265878 | 11/2010 |
| JP | 2015-025383 | 2/2015 |

* cited by examiner

CONTROL DEVICE FOR INTERNAL COMBUSTION ENGINE

CROSS REFERENCE TO RELATED APPLICATION

This application is the U.S. national phase of International Application No. PCT/JP2015/005503 filed Nov. 2, 2015 which designated the U.S. and claims priority to Japanese Patent Application No. 2014-224856 filed Nov. 5, 2014, the entire contents of each which are hereby incorporated herein by reference.

TECHNICAL FIELD

The present disclosure relates to a control device that controls an internal combustion engine.

BACKGROUND ART

In general, in a control system for an engine (internal combustion engine), a plurality of protrusions are disposed on an outer peripheral part of a signal rotor fixed on a crank shaft at a predetermined interval, and a tooth missing part in which the protrusion is missing at a specific crank angle is formed, and a crank angle sensor is disposed so as to face the outer peripheral part of the signal rotor. The tooth missing part is detected by using an interval of crank angle signals (pulse signal) output from the crank angle sensor being longer at a position (the specific crank angle) of the tooth missing part. Further, based on the position (the predetermined crank angle) of the tooth missing part, the crank angle is determined by using the crank angle signal and a cam angle signal and a cylinder is determined, and control of the engine (for example, fuel injection control, ignition control or the like) is performed.

Further, in recent years, in a vehicle in which an engine is mounted, an engine automatic stop-and-start control system is adopted for the purpose of reducing fuel consumption, reducing exhaust emissions or the like. In the vehicle having the engine automatic stop-and-start control system, when the engine is restarted, a quick start is required compared to when the engine is normally started (for example, when the engine is started by means of turn-on-operation of an ignition switch).

Thus, for example, in Patent Literature 1 (Japanese Patent No. 4310744), the crank angle when the engine is stopped is stored as engine stopping position information, and further change history of the crank angle signal in the engine stop is stored as the engine stopping position information. Further, when the engine is started, the cylinder discrimination is performed based on the engine stopping position information when the engine is stopped and during the engine stop.

Just before the engine is stopped, the crank shaft may rotate in a forward rotation direction and a backward rotation direction. Further, in a case in which a restart request is generated before the engine is completely stopped after an engine stop request to the engine is generated once, an engine speed may become faster or slower. At this time, in the both cases, a time interval of the crank angle signals may become extremely longer than the time interval detected immediately before. Thus, even if the tooth missing part is tried to be detected based on the time interval of the crank angle signal, when the fluctuation of the rotation speed of the crank shaft is generated, a part of the time interval of the crank angle signals being longer may be erroneously detected as a crank position reference part although it is not the crank position reference part. When the crank position reference part is erroneously detected, accuracy of the detection of the crank angle or the cylinder discrimination based on the position of the crank position reference part is deteriorated, and therefore the fuel injection control or the ignition control may not be performed normally when the engine is restarted. The technique disclosed in Patent Literature 1 described above cannot prevent the erroneous detection of the crank position reference part described above.

PRIOR ART LITERATURE

Patent Literature

Patent Literature 1: Japanese Patent No. 4310744

SUMMARY OF INVENTION

An object of the present disclosure is to provide a control device for an internal combustion engine capable of suppressing an erroneous detection of a crank position reference part which is a basis for determining a crank angle, and capable of performing a quick start of the engine when the engine is started.

According to one aspect of the present disclosure, the control device for an internal combustion engine has: a crank angle sensor that outputs a crank angle signal at a predetermined crank angle by synchronizing rotation of a signal rotor fixed on a crank shaft of the internal combustion engine, an interval of the crank angle signals being longer at a specific crank angle corresponding to a position of a crank position reference part of the signal rotor; and a control part that detects the crank position reference part, based on a time interval of the crank angle signals and controls the internal combustion engine by calculating a crank angle based on the crank angle signal corresponding to the position of the detected crank position reference part and discriminating a cylinder. Further, the crank angle sensor has a backward rotation detecting function that outputs different crank angle signals in a forward rotation of the crank shaft and in a backward rotation of the crank shaft. The control part disallows the detection of the crank position reference part when a stop request to the internal combustion engine is generated or when the backward rotation of the crank shaft is detected based on the crank angle signal, and controls the internal combustion engine by calculating the crank angle based on the crank angle of the crank position reference part detected before the disallowance and the crank angle signal.

According to the configuration described above, the signal rotor is fixed on the crank shaft of the internal combustion engine, and the crank angle signal is output by the crank angle sensor, and the crank position reference part of the signal rotor is detected based on the time interval of the crank angle signals output by the crank angle sensor. The crank angle is calculated and determined and cylinder discrimination is performed based on the crank angle signal corresponding to the position of the detected crank position reference part, and therefore the internal combustion engine is controlled. At this time, since the crank angle sensor has the backward rotation detecting function, by outputting different crank angle signals in the forward rotation of the crank shaft and in the backward rotation of the crank shaft, it is detected that the rotation direction of the engine is the backward rotation.

In the control device for an internal combustion engine, the control part disallows the detection of the crank position reference part when the stop request to the internal combustion engine is generated or when the backward rotation of the crank shaft is detected based on the crank angle signal. Further, the control part controls the internal combustion engine by calculating a crank position based on the crank angle of the crank position reference part detected before the disallowance and the crank angle signal. Accordingly, the erroneous detection of the crank position reference part is suppressed when the rotation speed of the crank shaft is fluctuated or when the backward rotation of the crank shaft is generated, and the quick start of the internal combustion engine becomes possible.

BRIEF DESCRIPTION OF DRAWINGS

The above and other objects, features and advantages of the present disclosure will become more apparent from the following detailed description made with reference to the accompanying drawings. In the drawings.

EMBODIMENT FOR CARRYING OUT INVENTION

Hereinafter, a present embodiment will be described with reference to drawings.

Figure 1:
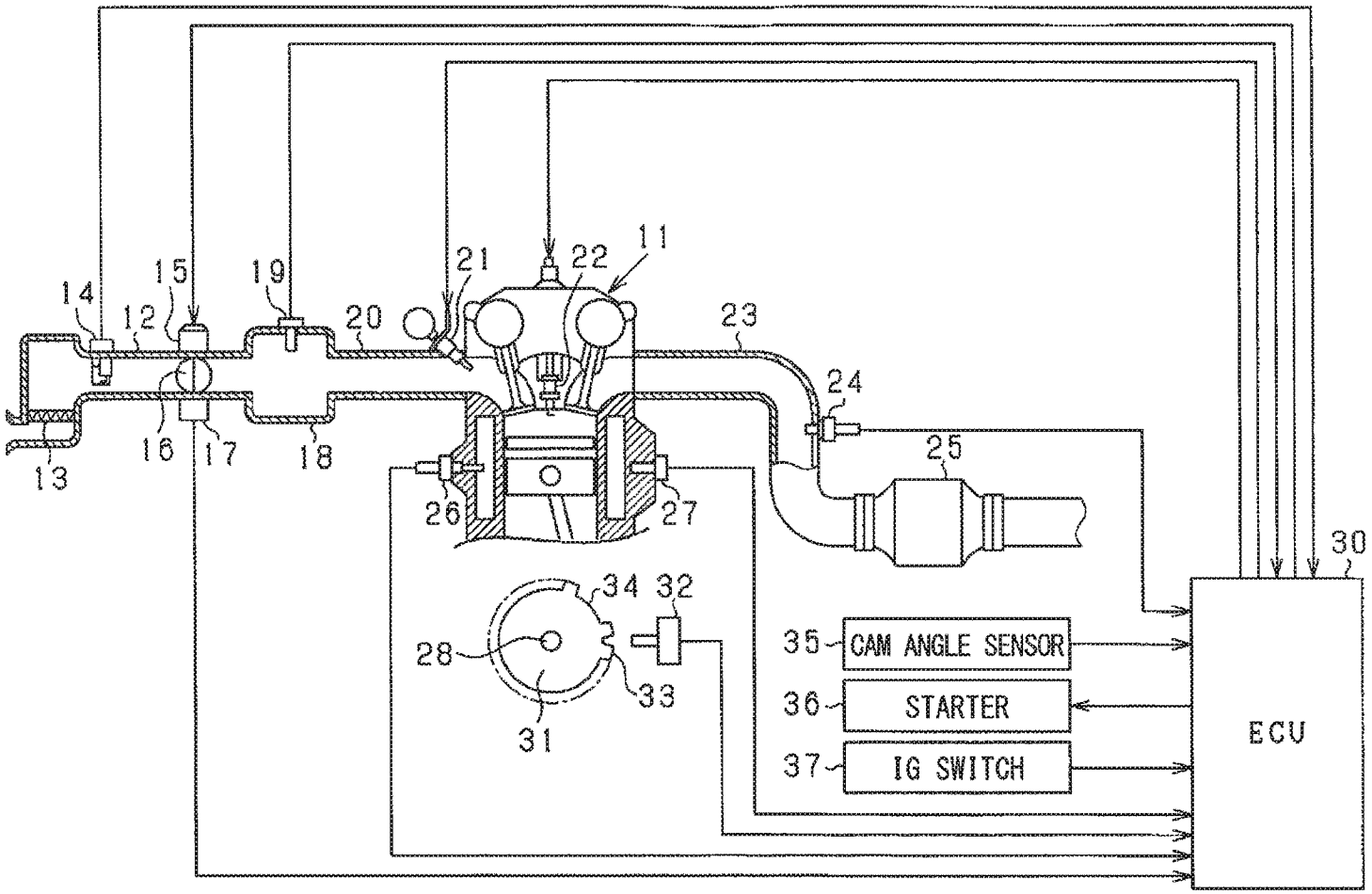
FIG. 1 is schematic diagram showing a control device for an internal combustion engine according to a present embodiment.

First, a schematic whole configuration of an engine control system will be described with reference to FIG. 1.

An air cleaner 13 is disposed at a most upstream part of an intake pipe 12 of an engine 11 (for example, gasoline engine, diesel engine or the like). An air flow meter 14 that detects an intake air quantity is disposed at a downstream side of the air cleaner 13. A throttle valve 16 in which an opening thereof is adjusted by a motor 15 and a throttle opening sensor 17 that detects the opening (throttle opening degree) of the throttle valve 16 are disposed at a downstream side of the air flow meter 14.

Further, a surge tank 18 is disposed at a downstream side of the throttle valve 16. An intake pressure sensor 19 that detects intake pressure is disposed in the surge tank 18. Further, an intake manifold 20 that introduces air into each cylinder of the engine 11 is disposed in the surge tank 18. A fuel injection valve 21 that injects fuel to each intake port is mounted to the intake port connected to the intake manifold 20 of each cylinder or is mounted to a part adjacent to the intake port (alternatively, the fuel injection valve that directly injects fuel to each cylinder is mounted to each cylinder of the engine 11). Further, an ignition plug 22 is mounted to a cylinder head of the engine 11 so as to correspond to each cylinder, and air-fuel mixture in each cylinder is ignited by spark discharge generated by the ignition plug 22 of each cylinder.

Further, an exhaust gas sensor 24 (air/fuel ratio sensor, oxygen sensor or the like) that detects an air/fuel ratio of the air-fuel mixture, rich/lean burn of the air-fuel mixture or the like based on exhaust gas is disposed in an exhaust pipe 23 of the engine 11. A catalyst 25 such as three way catalyst that purifies the exhaust gas is disposed at a downstream side of the exhaust gas sensor 24. A cooling water temperature sensor 26 detecting a cooling water temperature and a knock sensor 27 detecting a knocking are mounted to a cylinder block of the engine 11.

Further, a crank angle sensor 32 is disposed to face an outer peripheral part of a signal rotor 31 fixed on a crank shaft 28 of the engine 11, and crank angle signals (pulse signals) are output from the crank angle sensor 32 at each predetermined crank angle in synchronization with rotation of the signal rotor 31 (the crank shaft 28). A plurality of protrusions 33 are disposed on the outer peripheral part of the signal rotor 31 at predetermined intervals, and a tooth missing part 34 (corresponding to a crank position reference part) provided by a part in which one or more protrusions 33 is missing at a specific crank angle.

The crank angle sensor 32 outputs the crank angle signals every time when facing the protrusion 33 in accordance with the rotation of the signal rotor 31, and therefore an interval between the crank angle signals at a position of the tooth missing part 34 (the specific crank angle) becomes longer. The crank angle sensor 32 has a backward rotation detecting function that outputs different crank angle signals (for example, crank angle signals having different pulse widths) in the forward rotation and in the backward rotation of the crank shaft 28.

Further, a cam angle sensor 35 is disposed to face an outer peripheral part of a signal rotor (not shown) fixed on a cam shaft (not shown) of the engine 11, and a cam angle signals (pulse signals) are output from the cam angle sensor 35 at each predetermined cam angle by synchronizing rotation of the signal rotor (the cam shaft).

Outputs of these various sensors are input to an electric control unit 30 (hereinafter, referred to as "ECU"). The ECU 30 (control part) is mainly provided with a microcomputer. The ECU 30 controls a fuel injection quantity, an ignition timing, a throttle opening (intake air quantity) and the like in accordance with a driving state of the engine by executing various programs for controlling the engine stored in an embedded ROM (storage medium).

At this time, the ECU 30 calculates a time interval T of crank angle signals (a time interval between the output timing of the present crank angle signal and the output timing of the preceding crank angle signal) at each output timing of the crank angle signals (for example, at each of rising timing and falling timing of the crank angle signal). The ECU 30 detects the tooth missing part 34 based on the time interval T of the crank angle signals, and determines the crank angle by using the crank angle signal and the cam angle signal on the basis of the position of the tooth missing part 34 (the specific crank angle), and discriminates the cylinder, and performs control of the engine 11 (for example, fuel injection control, ignition control or the like).

Specifically, the crank signal is formed as a pulse train having basically 10° CA intervals, and in the middle of the pulse train, the tooth missing part 34 is detected. In this case, the crank angle sensor 32 detects a High-level signal when the crank angle sensor 32 faces the protrusion 33, and detects a Low-level signal when the crank angle sensor 32 faces a part including tooth missing part 34 other than the protrusion 33. In the forward rotation, when the High-level signal is detected by the crank angle sensor 32, the crank angle (crank counter) is added by 10° CA (one count). Further, in the backward rotation, the crank angle (the crank counter) is returned. Further, when a ratio of the present value of the time interval between the detected High-level signal and the following High-level signal to be detected against the preceding value of the time interval (=the present value/preceding value) exceeds a predetermined ratio (for example, 2.5), it is detected as the tooth missing part 34. Further, when the tooth missing part 34 is detected, the crank angle (the crank counter) is renewed to the crank angle corresponding to the tooth missing part 34.

Further, the ECU 30 performs an engine automatic stop-and-start control by executing an engine automatic stop-and-start control routine not shown. In the engine automatic stop-and-start control, for example, when a driver stops or decelerates the vehicle during driving of the engine 11 and an automatic stop condition is satisfied, the engine 11 is automatically stopped. After that, when the driver starts or accelerates the vehicle during the automatic stopping of the engine 11 and an automatic start condition (restart condition) is satisfied, the engine 11 is restarted by automatically driving a starter 36 and cranking the engine 11. Further, in a case in which a self-sustained driving of the engine 11 is possible, for example in a case in which the rotation speed of the engine 11 is faster than a predetermined rotation speed, the driving of the starter 36 may be omitted.

At this time, the automatic stop condition means a state of driving operation of the vehicle in which the vehicle should be temporarily stopped, and for example, at least one of the following factors may be used for determining the automatic stop condition. (i) Brake ON (an operation amount of a brake pedal is more than a predetermined amount), (ii) Accelerator OFF (Acc<Acc0 (a predetermined value)), and (iii) Vehicle speed "ve" is less than a predetermined value (ve<ve0 (a predetermined value)). Specifically, in the present embodiment, the ECU 30 determines that the automatic stop condition is satisfied when all conditions of (i) to (iii) are satisfied.

Figure 2:
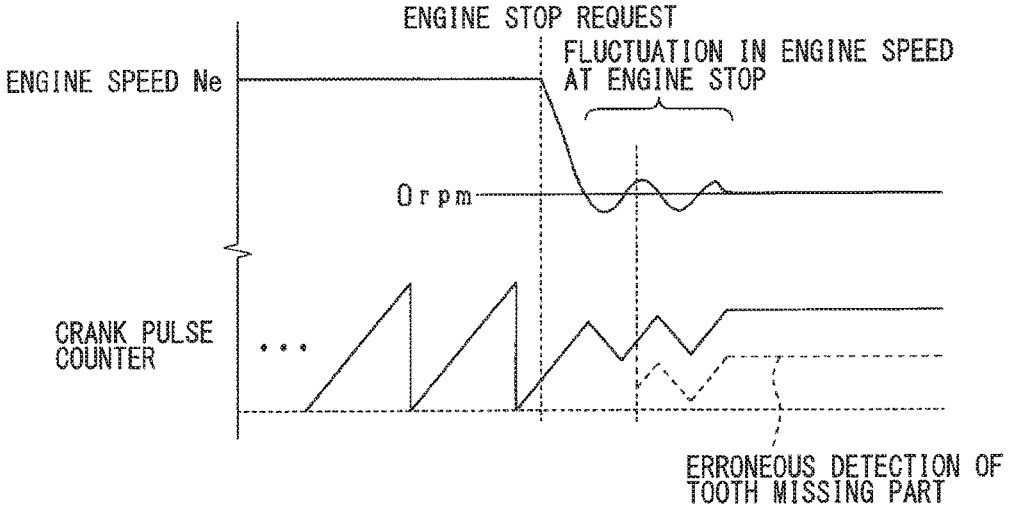
FIG. 2 is a time chart showing erroneous detection of a tooth missing part.
Figure 3:
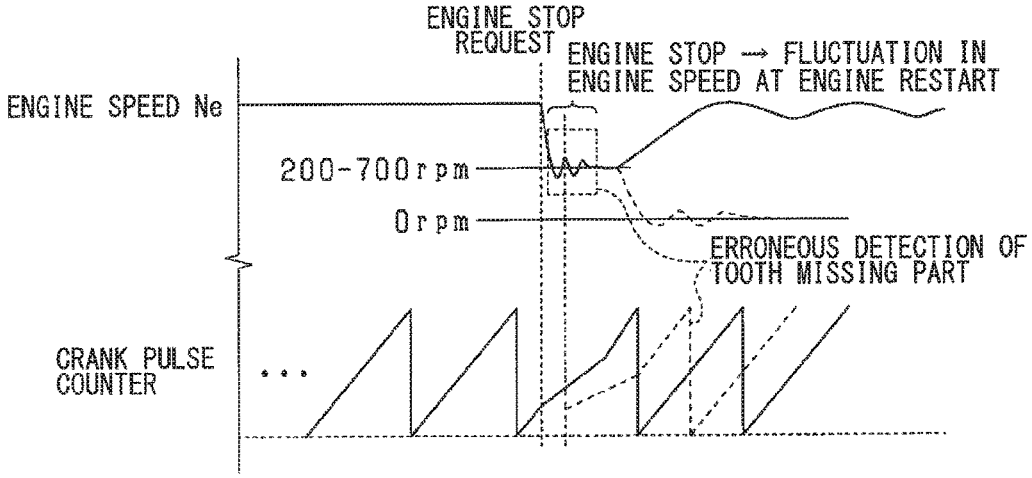
FIG. 3 is a time chart showing the erroneous detection of the tooth missing part.

On the other hand, as shown in FIG. 2, just before the engine 11 is stopped, the crank shaft 28 may rotate in a forward rotation direction and a backward rotation direction. Alternatively, as shown in FIG. 3, in a case in which a restart request to the engine 11 is generated when an engine speed reaches a lower rotation range after a stop request to the engine 11 is generated, the rotation speed of the engine 11 may be fluctuated. Further, in another case, the rotation direction of the engine 11 may be reversed without the stop request to the restart request of the engine 11. In this case, the time interval between the High-level signal of the crank angle signal detected by the crank angle sensor 32 and the following High-level signal to be detected may be extremely longer compared to the time interval detected immediately before.

Thus, even when the detection of the tooth missing part 34 is implemented based on the time interval of the crank angle signals when the crank shaft 28 is rotated in the forward rotation by using the crank angle sensor 32 having the backward rotation detecting function, a part of the time interval of the crank angle signals being longer may be erroneously detected as the tooth missing part 34 although it is not the tooth missing part 34. When the tooth missing part 34 is erroneously detected during the stopping of the engine 11, accuracy of the determination of the crank angle or the cylinder discrimination based on the position of the tooth missing part 34 is deteriorated, and therefore the fuel injection control or the ignition control may not be performed normally when the engine 11 is restarted.

In the present embodiment, a tooth-missing detection and determination routine of FIG. 4 described below is executed by the ECU 30, and therefore when the stop request to the engine 11 is generated or when the backward rotation of the crank shaft 28 is detected based on the crank angle signal, the detection of the tooth missing part 34 is disallowed, and when the restart request to the engine 11 is generated, the detection of the tooth missing part 34 is allowed.

Hereinafter, a process of the tooth-missing detection and determination routine of the FIG. 4 executed by the ECU 30 will be described. The tooth-missing detection and determination routine shown in FIG. 4 is repeatedly executed by the ECU 30 at a predetermined frequency during a period in which the ECU 30 has been turned ON.

When this routine is activated, firstly, it is determined whether the restart request to the engine 11 is generated in Step 100. In the present embodiment, for example, it is determined that the restart request to the engine 11 is generated when at least one of the following cases of (1) to (3) is occurred during a period in which the engine 11 has been automatically stopped or fuel supply has been interrupted (stopping process).

(1) Starter 36 has been driven.

(2) Brake OFF (the operation amount of the brake pedal is less than the predetermined amount).

(3) Accelerator ON (Acc≥Acc0 (the predetermined value)).

In Step 100, in a case in which it is determined that the restart request to the engine 11 is generated (S100: Yes), the process proceeds to Step 110. In Step 110, it is determined whether a predetermined time period is elapsed since the restart request to the engine 11 is generated or whether the engine 11 is rotated more than a predetermined number of rotations since the restart request to the engine 11 is generated. In Step 110, in a case in which it is determined that the predetermined time is elapsed since the restart request to the engine 11 is generated or the engine 11 is rotated more than the predetermined number of the rotation since the restart request to the engine 11 is generated (S110: YES), the process proceeds to Step 120. In Step 120, the detection of the tooth missing part 34 is allowed and this routine is ended.

On the other hand, in Step 100, in a case in which it is determined that the restart request to the engine 11 is not generated (S100: NO), the process proceeds to Step 130 or Step 140.

In Step 130, it is determined whether the stop request to the engine 11 is generated. Specifically, it is determined that the stop request to the engine 11 is generated when at least one of the following cases of (1) or (2) is occurred during driving of the engine 11.

(1) The automatic stop condition is satisfied.

(2) An IG switch 37 (ignition switch) is operated to be turned OFF.

In Step 130, in a case in which it is determined that the stop request to the engine is generated (S130: YES), the process proceeds to Step 150, and in Step 150, the detection of the tooth missing part 34 is disallowed and this routine is ended. Further, when a crank counter is matched with a crank angle corresponding to the tooth missing part 34 after the detection of the tooth missing part 34 is disallowed, the crank counter is added by the crank angle corresponding to the tooth missing part 34 (for example, 40° C.A (crank angle)). Further, when the High-level signal is detected by the crank angle sensor 32 during the forward rotation, the crank angle (the crank counter) is added by 10° C.A (one count). In other words, the crank angle is calculated based on the crank angle of the tooth missing part 34 detected before disallowance and the crank angle signal.

In Step 110, in a case in which the rotation time period of the engine 11 is less than the predetermined time period or the number of the rotation of the engine 11 is less than the predetermined number of the rotation (S110: NO), or in Step 130, in a case in which it is determined that the stop request to the engine is not generated (S130: NO), the process proceeds to Step 140.

In Step 140, it is determined whether the backward rotation of the crank shaft 28 is generated based on the crank angle signal. In Step 140, in a case in which it is determined that the backward rotation of the crank shaft 28 is generated (S140: YES), it is determined that the erroneous detection in which a part of the time interval of the crank angle signals being longer is detected as the tooth missing part 34 although it is not the tooth missing part 34 may be generated, and the process proceeds to Step 150. In Step 150, the detection of the tooth missing part 34 is disallowed and this routine is ended. Further, in Step 140, in a case in which it is determined that the backward rotation of the crank shaft 28 is not generated (S140: NO), this routine is ended as it is.

Further, in an initial start of the engine 11 (IG is turned ON), even when the backward rotation of the engine 11 is detected by the crank angle sensor 32, the detection of the tooth missing part 34, which has been disallowed, is compulsively resumed (the detection is compulsively allowed).

With the configuration described above, the control device for an internal combustion engine according to the present embodiment can achieve the following effects.

In the control device for an internal combustion engine, the ECU 30 disallows the detection of the tooth missing part 34 when the stop request to the engine 11 is generated or when the backward rotation of the crank shaft 28 is detected based on the crank angle signal. The ECU 30 performs the control of the internal combustion engine by calculating the crank position based on the crank angle of the tooth missing part 34 detected before the disallowance and the crank angle signal. Thus, the erroneous detection of the tooth missing part 34 is suppressed when the rotation speed of the crank shaft 28 is fluctuated or when the backward rotation of the crank shaft 28 is generated, and the quick start of the engine 11 becomes possible.

The ECU 30 cancels the disallowance of the detection tooth missing part 34 when the predetermined time is elapsed or the engine 11 is rotated more than the predetermined number of the rotation, in addition to the generation of the restart request to the engine 11. Thus, in a case in which possibility of the erroneous detection of the tooth missing part 34 is low, it is possible to allow the detection of the tooth missing part 34.

The ECU 30 compulsively cancels the disallowance of the detection of the tooth missing part 34 when the initial start request to the engine 11 is generated. Thus, even if the vehicle is temporarily moved rearward in starting by pushing the vehicle (so called push-start), it is possible to perform the cylinder discrimination normally without disallowing the detection of the tooth missing part 34.

The ECU 30 can suppress the erroneous detection of the tooth missing part 34 when the engine 11 is automatically stopped, and further the quick start of the engine 11 becomes possible.

Further, the present embodiment may be modified as described below.

A plurality of the protrusions 33 are disposed at the same interval and the tooth missing part 34 in which one or more protrusions 33 are missing at the specific crank angle is formed on the outer peripheral part of the signal rotor 31. Instead of this, a continuous tooth part may be formed in the outer peripheral part of the signal rotor 31 by disposing a plurality of protrusions continuously without forming a gap at a part to be detected.

In this case, the crank angle sensor 32 detects the High-level signal when the crank angle sensor 32 faces the protrusions 33 including the continuous tooth part, and detects the Low-level signal when the crank angle sensor 32 faces a part other than the protrusions 33. When a ratio of the present value of the interval between the detected Low-level signal and the following Low-level signal to be detected against the preceding value of the interval (=present value/preceding value) exceeds a predetermined ratio, it is detected as the continuous tooth part. In such a case, the disallowance or the allowance of the crank position detection according to present embodiment can be performed.

The present embodiment is adopted in a vehicle capable of restarting the engine 11 before the engine 11 is stopped. However, the present embodiment may be adopted in a vehicle incapable of restarting the engine 11 before the engine 11 is stopped. In such a case, when the engine is automatically restarted immediately after the engine is automatically stopped, the disallowance or the allowance of the crank position detection can be performed.

The present embodiment is adopted in a vehicle in which the engine 11 is automatically stopped or restarted when the predetermined condition is satisfied. However, the present embodiment may be adopted in a vehicle in which the engine 11 is not automatically stopped or restarted. In such a case, when the engine is manually started immediately after the engine is manually stopped, the disallowance or the allowance of the crank position detection can be performed.

In the present embodiment, the detection of the tooth missing part 34 is compulsively allowed when the initial start request to the engine 11 is generated. However, the present embodiment may be adopted in a vehicle in which the detection of the tooth missing part 34 is disallowed when the initial start request to the engine 11 is generated.

In the present embodiment, when at least one of the conditions of (1) Starter 36 has been driven, (2) Brake OFF (the operation amount of the brake pedal is less than the predetermined amount), and (3) Accelerator ON (Acc≥Acc0 (the predetermined value)) is satisfied, it is determined that the restart request to the engine 11 is generated. However, conditions of (4) The forward rotation of the engine 11 has been continued for more than a predetermined period, and (5) The rotation speed of the forward rotation of the engine 11 more than a predetermined rotation speed has been continued may be further added to the conditions described above. In such a case, it is possible to determine that the restart request is normally generated. Further, when the rotation speed of the engine 11 exceeds a predetermined rotation speed in addition to the generation of the restart request to the engine 11, the disallowance of the detection of the tooth missing part 34 may be canceled.

Figure 4:
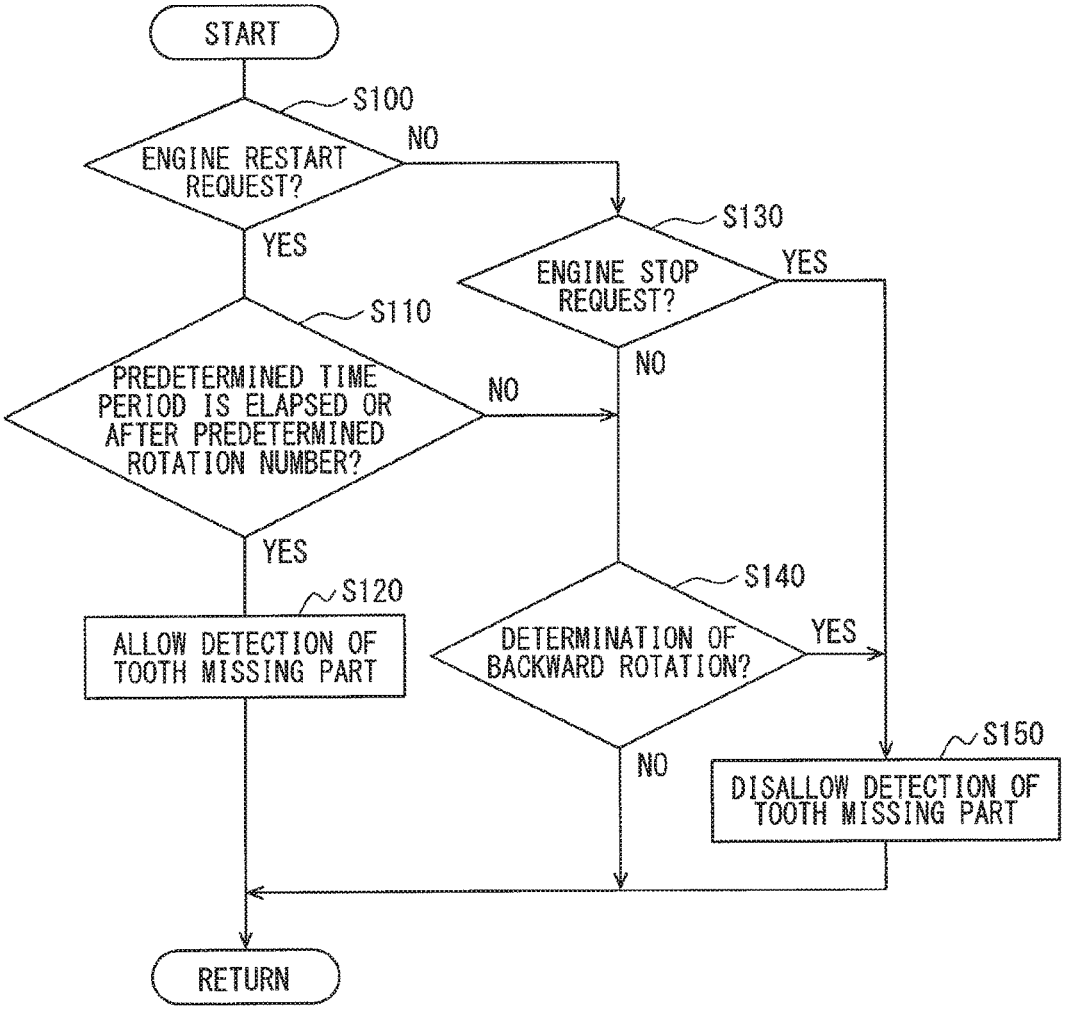
FIG. 4 is a control flowchart of an ECU according to the present embodiment.

As another modified example of the process of FIG. 4, in Step 130, it may be determined whether the backward rotation is generated, and in Step 140, it may be determined whether the stop request to the engine is generated, instead of Step 130 in which it is determined whether the stop request to the engine is generated and Step 140 in which it is determined whether the backward rotation is generated. In such a case, the detection of the tooth missing part can be normally disallowed.

In the present embodiment, when the ratio of the present value of the time interval between the High-level signal detected by the crank angle sensor 32 and the following High-level signal to be detected against the preceding value of the time interval exceeds the predetermined ratio, it is detected as the tooth missing part 34. However, when a difference between a preceding value and a present value of the interval of the High-level signal and the following High-level signal to be detected (present value–preceding value) exceeds a predetermined value, it may be detected as the tooth missing part 34. In such a case, the detection of the tooth missing part 34 can be normally performed.

The present embodiment is applied to a gasoline engine. However, an engine control system having the present embodiment for a diesel engine may be provided. In such a case, a similar effect to the present embodiment described above can be obtained by performing the disallowance and the allowance of the crank position detection.

The control of the present embodiment is performed by the ECU 30. However, a microcomputer that performs different control from the engine control may be used for the control of the present embodiment.

The invention claimed is:

1. A control device for an internal combustion engine, the control device comprising:

a crank angle sensor that outputs a crank angle signal at a predetermined crank angle and a regular interval by synchronizing rotation of a signal rotor fixed on a crank shaft of the internal combustion engine in such a manner that an interval of the crank angle signals is longer at a specific crank angle corresponding to a position of a crank position reference part of the signal rotor; and in such a manner that the interval of the crank angle signals at the predetermined crank angle is the regular interval excluding the position of the crank position reference part; and at least one processor configured to detect the crank position reference part based on a time interval of the crank angle signals and controls the internal combustion engine by calculating a crank angle based on the crank angle signal corresponding to the position of the detected crank position reference part and discriminating a cylinder, wherein:

the crank angle sensor includes a rotation detecting function that outputs different crank angle signals in a forward rotation of the crank shaft and in a backward rotation of the crank shaft; and the at least one processor is further configured, when a stop request to the internal combustion engine is generated or when the backward rotation of the crank shaft is detected based on the crank angle signal, to disallow the detection of the crank position reference part and to control the internal combustion engine by calculating the crank angle by adding the predetermined crank angle, in response to detection of the crank angle signal, to the crank angle of the crank position detected before the detection of the crank position reference part is disallowed, the at least one processor is further configured to execute an automatic stop of the internal combustion engine when a predetermined stop condition is satisfied, the at least one processor is further configured to execute a restart of the internal combustion engine when a predetermined restart condition is satisfied, the at least one processor is further configured to disallow the detection of the crank position reference part when an automatic stop request to the internal combustion engine is generated, the at least one processor is further configured to execute control of the internal combustion engine by calculating the crank position based on the crank position reference part detected before the detection of the crank position reference part is disallowed, and in a case in which the automatic stop request to the internal combustion engine is generated and a restart request to the internal combustion engine is generated before the internal combustion engine is completely stopped, the at least one processor is further configured to cancel the disallowance of the detection of the crank position reference part when at least one of two conditions of (i) the internal combustion engine is rotated more than a predetermined number of rotation and (ii) a rotation speed of the internal combustion engine is more than a predetermined rotation speed is satisfied.

2. The control device for an internal combustion engine according to claim 1, wherein the at least one processor is further configured to compulsively allow the detection of the crank position reference part when an initial start request to the internal combustion engine is generated.

3. The control device for an internal combustion engine according to claim 1, wherein:

the at least one processor is further configured, in response to a stop request to the internal combustion engine or detection of the backward rotation of the crank shaft based on the crank angle signal, to disallow the detection of the crank position reference part, to add the predetermined crank angle, in response to detection of the crank angle signal, to the crank angle of the crank position, which is detected before the detection of the crank position reference part is disallowed, to calculate the crank angle to discriminate the cylinder of the internal combustion engine based on a calculation result of the crank angle, and to perform a control of the internal combustion engine based on a discrimination result of the cylinder.

4. The control device for an internal combustion engine according to claim 1, wherein:

the at least one processor is further configured, in response to a stop request to the internal combustion engine or detection of the backward rotation of the crank shaft based on the crank angle signal, to disallow the detection of the crank position reference part, to continue addition of the predetermined crank angle, in response to detection of the crank angle signal, to the crank angle of the crank position, which is detected before the detection of the crank position reference part is disallowed, to calculate the crank angle, to continue discrimination of the cylinder of the internal combustion engine based on a calculation result of the crank angle, and to continue at least one of fuel injection control or ignition control of the internal combustion engine based on a discrimination result of the cylinder.

5. The control device for an internal combustion engine according to claim 1, wherein:

the at least one processor is further configured to add, to the crank angle, a crank angle corresponding to the crank position reference part, after the detection of the crank position reference part is disallowed.

6. A control device for an internal combustion engine, the control device comprising:

a crank angle sensor that outputs a crank angle signal at a predetermined crank angle by synchronizing rotation of a signal rotor fixed on a crank shaft of the internal combustion engine in such a manner that an interval of the crank angle signals is longer at a specific crank angle corresponding to a position of a crank position reference part of the signal rotor and in such a manner that the interval of the crank angle signals at the predetermined crank angle is a regular interval excluding the position of the crank position reference part; and at least one processor configured to detect the crank position reference part based on a time interval of the crank angle signals and controls the internal combustion engine by calculating a crank angle based on the crank angle signal corresponding to the position of the detected crank position reference part and discriminating a cylinder, wherein:

the crank angle sensor includes a rotation detecting function that outputs different crank angle signals in a forward rotation of the crank shaft and in a backward rotation of the crank shaft; and the at least one processor is further configured, when a stop request to the internal combustion engine is generated or when the backward rotation of the crank shaft is detected based on the crank angle signal, to disallow the detection of the crank position reference part and to control the internal combustion engine by calculating the crank angle by adding the predetermined crank angle, in response to detection of the crank angle signal, to the crank angle of the crank position detected before the detection of the crank position reference part is disallowed, the at least one processor is further configured to execute an automatic stop of the internal combustion engine when a predetermined stop condition is satisfied, the at least one processor is further configured to execute a restart of the internal combustion engine when a predetermined restart condition is satisfied, the at least one processor is further configured to disallow the detection of the crank position reference part when an automatic stop request to the internal combustion engine is generated, the at least one processor is further configured to execute control of the internal combustion engine by calculating the crank position based on the crank position reference part detected before the detection of the crank position reference part is disallowed, and in a case in which the automatic stop request to the internal combustion engine is generated and a restart request to the internal combustion engine is generated before the internal combustion engine is completely stopped, the at least one processor is further configured to cancel the disallowance of the detection of the crank position reference part when at least one of two conditions of (i) the internal combustion engine is rotated more than a predetermined number of rotation and (ii) a rotation speed of the internal combustion engine is more than a predetermined rotation speed is satisfied.

7. The control device for an internal combustion engine according to claim 1, wherein:

the predetermined crank angle is an angle between two protrusions that are disposed on an outer peripheral part of a signal rotor and are adjacent to each other.

8. A control device for an internal combustion engine, the control device comprising:

a crank angle sensor that outputs a crank angle signal at a predetermined crank angle and a regular interval by synchronizing rotation of a signal rotor fixed on a crank shaft of the internal combustion engine in such a manner that an interval of the crank angle signals is longer at a specific crank angle corresponding to a position of a crank position reference part of the signal rotor; and in such a manner that the interval of the crank angle signals at the predetermined crank angle is the regular interval excluding the position of the crank position reference part; and at least one processor configured to detect the crank position reference part based on a time interval of the crank angle signals and controls the internal combustion engine by calculating a crank angle based on the crank angle signal corresponding to the position of the detected crank position reference part and discriminating a cylinder, wherein:

the crank angle sensor includes a rotation detecting function that outputs different crank angle signals in a forward rotation of the crank shaft and in a backward rotation of the crank shaft; and the at least one processor is further configured, when a stop request to the internal combustion engine is generated or when the backward rotation of the crank shaft is detected based on the crank angle signal, to disallow the detection of the crank position reference part, and to control the internal combustion engine by calculating the crank angle based on the crank angle of the crank position reference part, which is detected before the detection of the crank position reference part is disallowed, and the crank angle signal, the at least one processor is further configured, when the crank angle is matched with a crank angle corresponding to the crank position reference part after the detection of the crank position reference part is disallowed, to add a reference crank angle, which corresponds to crank angle signals of the crank position reference part, to the crank angle, and to subsequently calculate the crank angle by adding the crank angle signal, in response to detection of the crank angle signal, to the crank angle, the at least one processor is further configured to execute an automatic stop of the internal combustion engine when a predetermined stop condition is satisfied, the at least one processor is further configured to execute a restart of the internal combustion engine when a predetermined restart condition is satisfied, the at least one processor is further configured to disallow the detection of the crank position reference part when an automatic stop request to the internal combustion engine is generated, the at least one processor is further configured to execute control of the internal combustion engine by calculating the crank position based on the crank position reference part detected before the detection of the crank position reference part is disallowed, and in a case in which the automatic stop request to the internal combustion engine is generated and a restart request to the internal combustion engine is generated before the internal combustion engine is completely stopped, the at least one processor is further configured to cancel the disallowance of the detection of the crank position reference part when at least one of two conditions of (i) the internal combustion engine is rotated more than a predetermined number of rotation and (ii)

a rotation speed of the internal combustion engine is more than a predetermined rotation speed is satisfied.

* * * * *